United States Patent [19]

Steffen

[11] 4,247,989

[45] Feb. 3, 1981

[54] METHOD FOR IDENTIFYING AND MAINTAINING A DORMANCY INDEX IN STORED GRAIN

[76] Inventor: Sylvester L. Steffen, R.R. 3, New Hampton, Iowa 50659

[21] Appl. No.: 973,352

[22] Filed: Dec. 26, 1978

[51] Int. Cl.[3] ..... F26B 7/00

[52] U.S. Cl. ..... 34/20; 34/34; 34/54; 34/89; 73/343 B; 73/355 R; 98/55; 250/339

[58] Field of Search ..... 73/355 R, 355 EM, 343 R, 73/343 B; 34/88, 89, 20, 34, 54, 67, 233; 98/52, 54, 55; 250/339, 342; 165/5, 11

[56] References Cited

U.S. PATENT DOCUMENTS

| | | | |
|---|---|---|---|
| 2,935,009 | 5/1960 | Cloud et al. | 34/54 |
| 3,474,671 | 10/1969 | Byron | 73/355 R |
| 3,563,460 | 2/1971 | Nine | 34/54 |
| 3,828,173 | 8/1974 | Knepler | 250/339 |
| 3,861,458 | 1/1975 | Ostranderet al. | 250/342 |
| 4,045,878 | 9/1977 | Steffen | 34/26 |
| 4,053,991 | 10/1977 | Steffen | 34/54 |
| 4,110,617 | 8/1978 | Legille | 250/342 |
| 4,121,459 | 10/1978 | MaCall et al. | 73/355 R |

*Primary Examiner*—Larry I. Schwartz
*Attorney, Agent, or Firm*—Henderson & Sturm

[57] ABSTRACT

The field of the instant invention pertains to identifying levels of vital activity in stored seeds. The instant invention teaches a method employing infrared sensors for determining the level of stability of stored grains, for detecting instability in grains, for detecting levels of preservation and/or deterioration of grain, as well as controlling means for restoring the grain environment to a stable condition.

5 Claims, 1 Drawing Figure

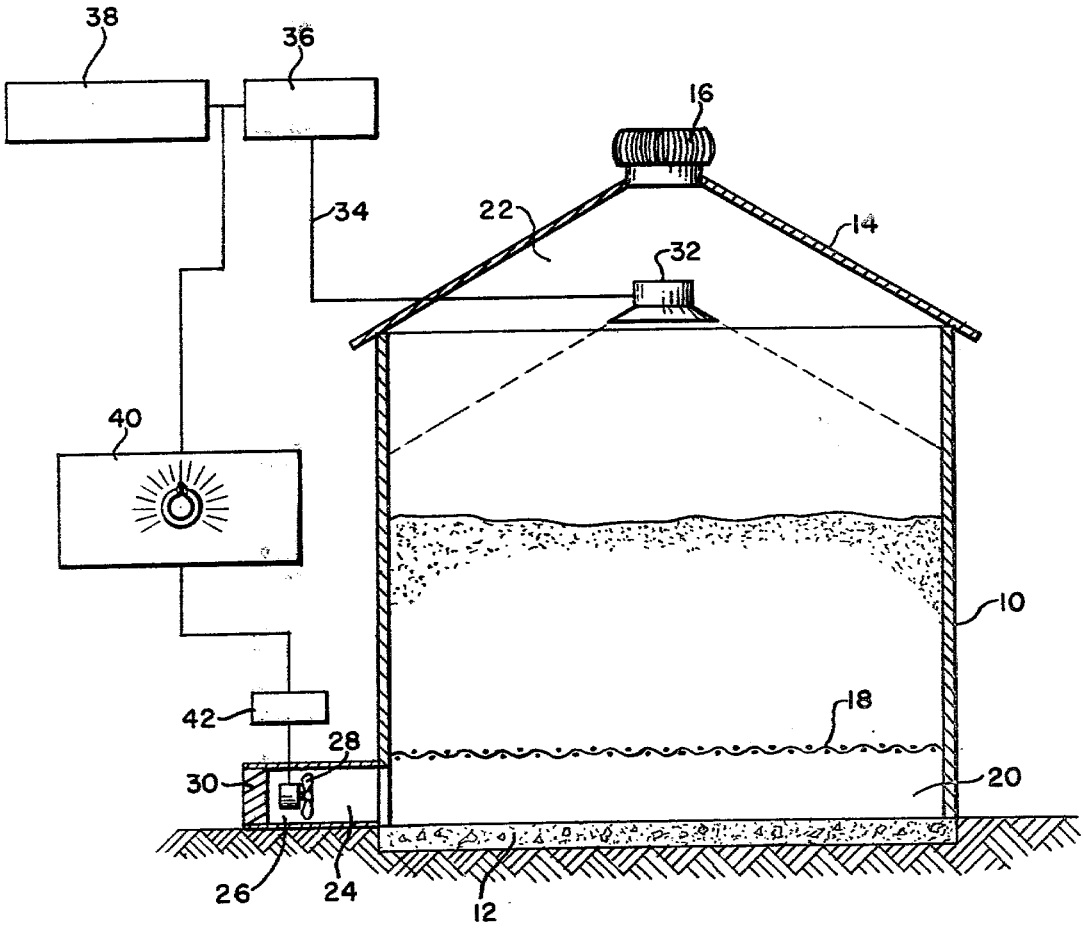
38
36
16
34
22
14
32
40
10
42
18
28
30
20
26
24
12

METHOD FOR IDENTIFYING AND MAINTAINING A DORMANCY INDEX IN STORED GRAIN

SUMMARY OF THE INVENTION

Nature is a study of harmony, of forces holding each other in balance. This economy of energy is true also of live-systems in their relationship with each other and with the atmosphere. For example, energy exchange between grain and the environment tells of happenings within the live grain system. Generally, application of energy to live-systems intensifies vital activities of the system. Growing plants for example, have specific mechanisms for utilizing energy coming to them from the atmosphere (sun). Seeds are a specific living system, designed to fulfill a specific function in the life-cycle of a plant system, which is to insure preservation of the plant species under conditions which otherwise are destructive of the growing system. The seed posseses special mechanisms enabling it to survive adverse environmental conditions which the plant cannot. Thus, the most characteristic phenomenon of the seed is what is termed "dormancy", i.e., the ability for the seed to assume an intense state of rest or stability wherein biochemical activities within it are at a minimum. Thus, its condition of stability is enhanced when it is exposed to the lowest possible temperature, given atmospheric conditions in that a higher temperature represents a state of higher energy expression.

Present techniques of controlling the environment of stored grain generally work on the principle of detecting heat in the grain with thermostats. Such techniques are sensitive only to respond after serious damage has been inflicted on the grain, and respond not to the grain but to heating that is the by-product of the infesting micro-organisms and not the grain itself.

Thus, it is readily seen that prior art methods lack the sensitivity of detection, whereas, the teaching of the present invention possesses such sensitivity and therefore affords a means of great value to all who work with grain in preserving maximum food and market value.

The instant invention teaches sensitivity to the grain and responding to stabilize the grain environment long before conditions deteriorate to the point that mold, bacterial and insect infestation exist.

BRIEF DESCRIPTION OF THE DRAWING

The single FIGURE is a schematic view, partly in section, showing a typical grain storage structure and its contents to which the present invention is applied.

DETAILED DESCRIPTION

In previous applications by Steffen the "dormancy index" of seeds has been identified as a maximum state of stability in seeds that occurs with the achievement of equilibrium in energy exchange between grain and the atmosphere.

Broadly, this condition is achieved when an equilibrium temperature and moisture between grain and the atmosphere is achieved. In U.S. Pat. No. 4,045,878, there is taught the expenditure of free-heat from the grain environment in the removal of "free-moisture" through controlled ventilation. The process is monitored and controlled by measuring the expenditure of free-heat (evaporative cooling) during the ventilation of grain. Further, Steffen has identified two distinct phases in management of grain after-harvest, namely the curing phase and the post-curing phase.

The curing phase is characterized by on-going processes wherein internal seed ingredients are adjusting to take on a more stable chemical configuration, during which process free moisture and free heat are released by the seed to the environment. The rate at which free heat and free moisture are released by the seed is determined by the state of maturity (stability) of the seed and by its temperature. In a less stable state, the seed respires more rapidly, which means that the output of $CO_2$ and $H_2O$ by the seed is at a more rapid rate. In Ser. No. 846,402, filed Oct. 28, 1977, Steffen identifies the triatomic structure of the water molecule as being of compatible harmonic energy with specific wavelengths of radiation in atmospheric air; further, the triatomic structure of $CO_2$ is recognized to have essentially the same harmonic relationship to this radiation (infrared) in atmospheric air. Thus, when the seed respires at a more rapid rate, kernel heat (radiation in the infrared spectrum) is carried by the water and carbon dioxide and removed from the seed, thus reducing it to a cooler, more stable state. However, when these are released from the seed to the interstitial airspaces, they will accumulate unless removed by ventilation. Their accumulation is a precursor to spoilage. Thus, detection of increased radiation of infrared from localized areas indicates the development of spoilage conditions in these areas.

As the grain approaches a state of equilibrium with the atmosphere, its respiratory rate is reduced too, so that release of water, carbon dioxide and heat also is decreased. This phenomenon correlates with other physical/chemical characteristics in the seeds and can be read as an indication of stability in the grain.

The post-curing phase deals with grain in a dormant state, namely a condition of maximum stability and equilibrium. In this state, energy-exchanges between grain and its environment are much more subtle and much more refined than in the curing state so that a more refined method for detecting them and signs of instability in the grain is required. The correct index for this is the output of energy from the seed itself. And since water and carbon dioxide are the products of respiration and since these carry heat from the grain, they indicate its stability, which is to say, the energy expression (infrared radiation) by the products of respiration become a useful indicator of seed dormancy and of potentially hazardous conditions. Localized accumulations of products of respiration would be detectible because of increased radiation of infrared emanating from them. Optical infrared scanners capable of detecting these are available.

The present invention recognizes the application of products of infrared technology to the instant process. Such techniques include the identification of specific wavelength emissions, correlations with other known factors of stability and instability in seeds; quantitative measures of specific wavelengths and correlation to other known factors of stability and instability in seeds; operation of means to stabilize grain environment when the occurrence of instable conditions (increased radiation) in grain takes place as indicated by quantitive increases (of heat) of specific wavelengths of infrared as compared against radiation from the grain mass; procedures for scanning bins of stored grain to detect pockets of instability in stored grain and visual identification on a screen or medium of the precise location of such pockets so remedies can be applied, e.g., ventilation or physical loosening of grain in these pockets.

The application of the present invention is shown, by way of example, to a controlled grain storage structure such as that disclosed in Steffen, U.S. Pat. No. 4,045,878. The structure or bin is designated at 10, erected on a concrete base 12 and having a conical roof 14 in the center of which is disposed a wind turbine 16 of conventional design. A perforated floor 18, spaced above the concrete base, supports the stored grain and provides a lower plenum chamber 20. A top plenum chamber 22 exists above the stored grain and exits upwardly to atmosphere by means of the turbine 16. The lower plenum chamber is connected at one side of the bin via a duct 24 to a fan chamber 26 in which is housed a blower fan 28, the inlet to which is controlled by a set of louvers 30.

The present invention provides an optical infrared scanner 32 at the top center of the bin. This scanner is capable of scanning the surface temperature of the grain (exclusive of the outer third of the bin radius due to atmospheric radiation at the bin wall). Since water is the universal medium for biochemical activity of living systems, its relation to infrared and to specific wavelengths within the infrared spectrum is exploited by the present invention. Specific wavelengths, highly absorbed by water, are 2.5 to 2.8 microns and 6.4 and 6.8 microns. Thus, when it is desired to energize water specifically to effect removal thereof with ventilated air, emission of infrared in specific wavelengths is caused to occur.

The scanner is part of a solid-state system connected at 34 to a receiver 36 which receives energy emissions from the scanner, and these infrared energy emissions are isolated and are converted to digital readings, for example, at 38; that is, a digital reading of temperature of the scanned grain surface is given. A selector or control 40 is employed to select a certain temperature and/or to a certain wavelength of infrared radiation, and is responsive to the results picked up at 38. When the temperature rises to the predetermined level, the fan 28 is activated in conjunction with a suitable timer 42 for a specified interval, depending upon the response within the digital system. The fan, of course, draws in outside air via the louvers 30 and forces this air into the lower plenum chamber 20 and thence upwardly through the top exit provided by the wind turbine 16. Activation of the fan continues until equilibrium is reached and stability is restored to grain environment, after which it is shut off. If desired, the louvers at 30 could be controlled to vary the amount of air intake. As explained in the above noted Steffen patent, if the outside wind has sufficient velocity, the turbine will be rotated to assist the ventilation process.

The triatomic structure of $CO_2$ give it response characteristics to infrared almost identical with water. Thus, when moisture accumulates in the respiring grain, the energy state of the released moisture and $CO_2$ is expected to emit at generally similar wavelengths, so that any increase of these wavelengths (or absence thereof but increased presence of others) on the grain would warn of increased moisture present before it could be otherwise detected and before any adverse effect could occur, such as molding or accelerated respiration. As shown above, the fan 28 and/or louvres 30 when responsive to emissions at certain wavelengths or rates, is activated, here automatically, to remove the accumulated moisture and heat. These emissions are correlated with temperature-increase from the mass of grain (surface).

The "dormancy index" is identified as a condition of maximum stability in the living seed, a condition brought on by biochemical responses within the seed to atmospheric conditions, i.e., temperature and moisture. Further, the responses depend on the interdependency of these two factors, which is to say, if the grain is at a certain temperature it will achieve its maximum state of stability at a different level of moisture than it would at another temperature. Thus, I have worked out a moisture relationship in grain to its dormancy index based on the approximate equilibrium state the seed will achieve by the month when exposed to atmospheric air.

The rate of respiration indicates the level of activity within the seed. Moisture and carbon dioxide are the products of respiration. The harmonic energy (heat) radiated by the moisture and carbon dioxide given off is detectible by infrared sensors. By repeated observations of this radiation under known conditions of temperature and moisture in the grain a rate of respiration curve can be plotted, and a condition of acceptable respiration can be identified with respect to grain temperature/moisture so that the dormancy index can be refined to a far greater degree with use of this technique than any other known technique.

In a maximum state of stability grain will hold to a constant rate of respiration. Due to atmospheric conditions, and due to internal and external factors in seeds stored in bulk, its environmental conditions can gradually change. The change generally will be to the detriment of the grain in that it results in accumulations of heat, moisture and carbon dioxide in the interstices between the stored seeds. Such accumulations, as has been previously observed, can increase the respiratory rate of the seed itself, but beyond that they can create conditions allowing dormant micro-organisms present on the grain to begin to activate and infest the grain. Further, such increases of warmth and moisture provide an ideal environment for grain insects and serious deterioration of the grain.

It has been observed that since $H_2O$, $CO_2$ and heat are the by-products of respiration, and that since the emitted heat merely reflects the energy level of the $H_2O$ and $CO_2$ emitted, quantitative and qualitative monitoring of that heat identifies the rate of respiration and level of stability or instability in the stored grain environment.

From the instant teaching it is understood that a useful methodology is identified for use in detecting the state of preservation of stored seeds, so as to identify true market and seed value of bulk-stored grains; and to provide a practical method to handlers of grain for measuring its quality status and for preserving its maximum food and market value.

Modifications of the preferred form of the invention can be made without departing from the intent and scope of the teachings of the instant application as specified in the disclosure and claims.

I claim:

1. A process which preserves maximum energy in live stored grain which includes:

a storage structure having means for supplying throughputs of atmospheric air to the grain;

comprising the monitoring of infrared radiation from the grain as the result of respiration of the grain irrespective of ambient temperatures; and controlling throughputs of air in response to conditions of infrared radiation so monitored.

2. The process of claim 1 wherein the exchange of energy between grain and its environment is constantly monitored, including: sensing the expenditure of heat from the air passing through the grain and continuing a throughput so long as an increasing state of stability continues within the grain as indicated by a decrease of infrared radiation from the grain mass.

3. The process of claim 1 wherein an equilibrium condition of temperature and moisture is achieved, which includes:

identifying the optimum moisture level in grain consistent with its specific temperature as indicated by the level of energy radiation from the grain.

4. The process of claim 1, characterized in monitoring infrared radiation in the wavelength ranges of those absorbed by water.

5. A method of determining the state of stability and preservation of live stored grain by sensing energy emission therefrom that occurs as a result of respiration of the grain, and correlating its emission to specific conditions of grain temperature/moisture.

* * * * *